US007772785B2

(12) United States Patent
Ushijima et al.

(10) Patent No.: US 7,772,785 B2
(45) Date of Patent: Aug. 10, 2010

(54) PARALLEL LIGHTING SYSTEM FOR SURFACE LIGHT SOURCE DISCHARGE LAMPS

(75) Inventors: Masakazu Ushijima, 30-24 Nogata 6-chome, Nakano-ku, Tokyo (JP) 165-0027; Daisuke Taido, Nakano (JP)

(73) Assignees: Masakazu Ushijima, Tokyo (JP); Hong-Fei Chen (TW)

( * ) Notice: Subject to any disclaimer, the term of this patent is extended or adjusted under 35 U.S.C. 154(b) by 181 days.

(21) Appl. No.: 12/153,669

(22) Filed: May 22, 2008

(65) Prior Publication Data

US 2008/0231212 A1 Sep. 25, 2008

Related U.S. Application Data

(62) Division of application No. 11/081,545, filed on Mar. 17, 2005, now Pat. No. 7,391,166.

(30) Foreign Application Priority Data

Mar. 19, 2004 (JP) ..... 2004-079571
Nov. 10, 2004 (JP) ..... 2004-326485

(51) Int. Cl.
*H05B 37/02* (2006.01)

(52) U.S. Cl. ..... 315/276; 315/219; 315/224; 315/277

(58) Field of Classification Search ..... 315/219, 315/224, 276, 277
See application file for complete search history.

(56) References Cited

U.S. PATENT DOCUMENTS 4,572,990 A 2/1986 Leale et al.
5,440,209 A * 8/1995 Nilssen ..... 315/219
5,495,405 A 2/1996 Fujimura et al.
6,087,757 A 7/2000 Honbo et al.
6,181,066 B1 * 1/2001 Adamson ..... 315/282
6,226,196 B1 5/2001 Toshinari et al.
6,278,448 B1 8/2001 Brown et al.

(Continued)

FOREIGN PATENT DOCUMENTS

EP 1 397 028 A1 3/2004

(Continued)

*Primary Examiner*—David Hung Vu
(74) *Attorney, Agent, or Firm*—Birch, Stewart, Kolasch & Birch, LLP

(57) ABSTRACT

Disclosed is a low-cost parallel lighting system for discharge lamps for a surface light source, which reduces nonuniform brightness and static noise, and fulfills a requirement that lamp currents of individual cold-cathode fluorescent lamps should be uniform and stabilized. In a surface light source system having multiple discharge lamps, there is a module which lights the discharge lamps in parallel and whose input terminal and electrodes on an opposite side to that side of the discharge lamps which is connected to the module are driven by voltage waveforms different in phase by 180 degrees from each other, wherein an input terminal of an opposite phase of the surface light source system is connected to an inverter circuit having outputs of opposite phases via a single shunt transformer in such a way as to cancel out magnetic fluxes generated by currents respectively flowing in windings of the shunt transformer, whereby the resonance frequency of the inverter circuit having outputs of opposite phases is matched to balance the outputs.

3 Claims, 18 Drawing Sheets

U.S. PATENT DOCUMENTS

| | | | |
|---|---|---|---|
| 6,310,444 | B1 | 10/2001 | Chang et al. |
| 6,417,833 | B1 | 7/2002 | Takemoto |
| 6,429,604 | B1 | 8/2002 | Chang |
| 6,459,216 | B1 | 10/2002 | Tsai et al. |
| 6,515,427 | B2 | 2/2003 | Oura et al. |
| 6,559,606 | B1 | 5/2003 | Chou et al. |
| 6,680,588 | B2 | 1/2004 | Park et al. |
| 6,717,372 | B2 | 4/2004 | Lin et al. |
| 7,282,868 | B2 | 10/2007 | Ushijima et al. |
| 2002/0125838 | A1 | 9/2002 | Tsai |
| 2002/0140538 | A1 | 10/2002 | Yer et al. |
| 2003/0141829 | A1 | 7/2003 | Yu et al. |
| 2004/0183448 | A1 | 9/2004 | Hsueh et al. |
| 2005/0088113 | A1 | 4/2005 | Ushijima |
| 2005/0093471 | A1 | 5/2005 | Jin |
| 2005/0093472 | A1 | 5/2005 | Jin |
| 2005/0218827 | A1 | 10/2005 | Ushijima et al. |

FOREIGN PATENT DOCUMENTS

| | | | |
|---|---|---|---|
| JP | 11-27955 | | 1/1999 |
| JP | 6717372 | A | 2/2002 |
| JP | 2002-164193 | A | 6/2002 |
| JP | 2002164193 | A | 6/2002 |
| JP | 93102819 | A | 10/2002 |
| JP | 2005-317253 | A | 11/2005 |
| TW | 478292 | | 3/2001 |
| TW | 521 947-Y | A1 | 2/2003 |
| TW | 594 808-B | A1 | 6/2004 |

* cited by examiner

PARALLEL LIGHTING SYSTEM FOR SURFACE LIGHT SOURCE DISCHARGE LAMPS

This application is a Divisional of co-pending application Ser. No. 11/081,545 filed on Mar. 17, 2005, now U.S. Pat. No. 7,391,166, and for which priority is claimed under 35 U.S.C. §120; and this application claims priority under 35 U.S.C. §119 of Application No. JP-2004-79571 and JP-2004-326485 filed in Japan on Mar. 19, 2004 and Nov. 10, 2004; the entire contents of all are hereby incorporated by reference.

TECHNICAL FIELD

The present invention relates to an application of the invention disclosed in U.S. Pat. No. 5,495,405 (corresponding to Japanese Patent No. 2733817) by the inventors of the present invention or the use of the technical subject matters of that invention, and pertains to a parallel lighting system for elongated discharge lamps for a surface light source which require a high voltage, such as a cold-cathode fluorescent lamp (CCFL), an external electrode fluorescent lamp (EEFL) and a neo lamp, for use in a large surface light source system for liquid crystal display televisions, general-purpose illumination and the like.

BACKGROUND OF THE INVENTION

Recently, backlights for liquid crystal display are becoming larger and cold-cathode fluorescent lamps to be used for backlights are becoming longer.

Accordingly, the discharge voltage is becoming higher. So is the discharge impedance.

The EEFL requires a higher discharge voltage.

Because a large surface light source for a liquid crystal display television or the like requires that the brightness of the surface light source should be uniform, the surface light source is provided for each cold-cathode fluorescent lamp with a mechanism which detects the currents that flows in the cold-cathode fluorescent lamp and feeds the detection result to a control circuit to keep the lamp current constant, as shown in FIG. 12.

Many of the conventional discharge lamp lighting systems generally light discharge lamps by setting the electrode on one side of a cold-cathode fluorescent lamp to a high voltage and driving the electrode at the other end with the GND (ground) level. Such a lighting scheme is called "single-side high voltage driving", and the drive method is advantageous in that the lamp current control is easy so that a lighting circuit is easy to configure.

As cold-cathode fluorescent lamps become longer, the discharge voltage of the cold-cathode fluorescent lamps gets higher and the impedance of discharge lamps gets higher, so that the difference in brightness between the high-voltage side and low-voltage side of the cold-cathode fluorescent lamp stands out. Such a phenomenon is called "nonuniform brightness".

While the nonuniform brightness phenomenon does not distinctly occur on a cold-cathode fluorescent lamp alone, it apparently occurs when the cold-cathode fluorescent lamp is placed closer to a proximity conductor, such as a reflector. (See Japanese Laid-Open Patent Publication (Kokai) No. H11-8087 and Japanese Laid-Open Patent Publication (Kokai) No. H11-27955.)

As single-side high voltage driving results in large nonuniform brightness, a so-called double-side high voltage driving system or a floating system is proposed to reduce nonuniform brightness by driving both ends of a cold-cathode fluorescent lamp with high voltages of opposite phases, as shown in FIG. 13. Because the voltage to be applied to each electrode of a cold-cathode fluorescent lamp becomes a half, this system is advantageous in driving an elongated cold-cathode fluorescent lamp or external electrode fluorescent lamp which require a high voltage.

As the voltage to be applied to each electrode becomes a half, a leak current which is the flow of the current due to a parasitic capacitance produced around a discharge lamp becomes smaller, making the brightness of the cold-cathode fluorescent lamp more uniform.

In addition, the voltage to be applied to the windings of a step-up transformer becomes lower, increasing the safety of the step-up transformer.

It is said that double-side high voltage driving is suitable for driving elongated cold-cathode fluorescent lamps in a large surface light source.

As a cold-cathode fluorescent lamp is driven with a high voltage, however, there is large static noise generated from the cold-cathode fluorescent lamp.

As the static noise affects the liquid crystal display, every other cold-cathode fluorescent lamps are alternately driven with outputs different in phase by 180 degrees to cancel out static noise generated from the cold-cathode fluorescent lamp, as disclosed in Japanese Laid-Open Patent Publication (Kokai) No. 2000-352718.

FIG. 15 shows one example of the structure in which the secondary winding of a transformer takes a floating structure to provide outputs of opposite phases, which are connected to one ends of cold-cathode fluorescent lamps whose other ends are connected together so that the cold-cathode fluorescent lamps are driven in the form of parallel connection.

The lamp currents of individual fluorescent lamps are detected by current detection means $CDT_1$ to $CDT_4$ respectively, are feedback to voltage sources $WS_1$ to $WS_4$ to make the lamp currents uniform and stable.

As adjoining cold-cathode fluorescent lamps are driven with voltages different in phase by 180 degrees, therefore, static noise generated from the cold-cathode fluorescent lamp is canceled, thus reducing the influence on the liquid crystal display.

FIG. 16 shows one example in which the above method is further modified. A transformer with a floating structure is provided for each cold-cathode fluorescent lamp, and every other cold-cathode fluorescent lamps are alternately driven with outputs different in phase by 180 degrees to cancel out static noise.

Further, as the wires of a high voltage are long according to the method illustrated in FIG. 16, the structure that is shown in FIG. 17 is taken where a leakage flux transformer is arranged on either side to make the high-voltage wires shorter.

While each of FIGS. 16 and 17 exemplarily shows an AC power source, in an inverter circuit for an actual large surface light source is provided with a lamp current control circuit as shown in FIG. 12 for each transformer. This makes the scale of the circuit huge.

A problem that the circuit scale of an inverter circuit in a large surface light source system becomes huge can be overcome by means of driving multiple cold-cathode fluorescent lamps used in a surface light source in parallel to thereby make the lamp currents of the individual discharge lamps uniform. The solution is proposed by the inventors of the present invention in U.S. Laid-Open Patent Publication No.

2004-0155596-A1 (corresponding to Japanese Laid-Open Patent Publication (Kokai) No. 2004-00374) and illustrated in FIG. 18.

According to the single-side high voltage driving system, one electrode side of a cold-cathode fluorescent lamp becomes a high voltage while the other electrode side is the GND (ground) level. When multiple cold-cathode fluorescent lamps are driven in parallel by the method illustrated in FIG. 18 and proposed in U.S. Laid-Open Patent Publication No. 2004-0155596-A1, electrodes on one side of adjoining ones of multiple cold-cathode fluorescent lamps are in phase.

Such a single-side high voltage driving system has a problem of large nonuniform brightness. In addition, static noise generated from the cold-cathode fluorescent lamp is large, which may influence the liquid crystal display.

To cut off static noise generated from a surface light source, therefore, it is necessary to insert a conductive film coated with ITO (Indium Trioxide) or so between the surface light source and the liquid crystal display panel.

Such nonuniform brightness occurs when a cold-cathode fluorescent lamp is placed close to a reflector and is such that the high-voltage side is bright while the low-voltage side is dark. It is said that such nonuniform brightness is not avoidable in a large surface light source.

The nonuniform brightness increases when the impedance of a cold-cathode fluorescent lamp is high or when the parasitic capacitance around the cold-cathode fluorescent lamp is large because the current flows to a nearby conductor via the parasitic capacitor. Even when the drive frequency of a cold-cathode fluorescent lamp becomes higher, therefore, nonuniform brightness becomes greater.

It is often the case where the lamp current is made smaller to extend the service life of a cold-cathode fluorescent lamp for a backlight for a liquid crystal display television. Reducing the lamp current also means an increase in the impedance of the cold-cathode fluorescent lamp.

As an elongated cold-cathode fluorescent lamp is used in a large liquid crystal display television and originally has a high impedance, the impedance of the cold-cathode fluorescent lamp becomes higher for the two reasons mentioned above, so that particularly, nonuniform brightness is likely to occur.

If a cold-cathode fluorescent lamp is long, the outside diameter should be made larger to provide a strength. While a cold-cathode fluorescent lamp for a backlight (surface light source) for a notebook type personal computer is normally 1.8 mm to 2.7 mm in diameter, a cold-cathode fluorescent lamp in use for a backlight (surface light source) for a liquid crystal display television is about 3 mm to 5 mm in diameter. The increased outside diameter of a cold-cathode fluorescent lamp means that the parasitic capacitance produced between the cold-cathode fluorescent lamp and the reflector becomes greater.

In a large surface light source, therefore, not only the impedance of the cold-cathode fluorescent lamp is high but also the parasitic capacitance is high, resulting in overlapped conditions of making nonuniform brightness likely to occur. In view of this, it is said to be difficult to drive a large liquid crystal display backlight having an elongated cold-cathode fluorescent lamp on a high frequency.

Because the nonuniform brightness phenomenon is such that a high-potential portion near the electrode of a cold-cathode fluorescent lamp becomes bright while a low-potential portion becomes dark, nonuniform brightness occurs less in the double-side high voltage driving system than in the single-side high voltage driving system. (See Japanese Laid-Open Patent Publication (Kokai) No. H11-8087 and Japanese Laid-Open Patent Publication (Kokai) No. H11-27955.)

In the case of double-side high voltage driving, portions near the electrodes on both sides become bright while the center portion becomes dark. Nonuniform brightness in this case is considerably smaller than nonuniform brightness in the case of single-side high voltage driving. When double-side high voltage driving is employed, therefore, the drive frequency can be increased.

With double-side high voltage driving, an inverter circuit requires two outputs of opposite phases.

In the case of the structure where the outputs of the inverter circuit are provided with leakage flux transformers and are connected directly to electrodes on both sides of a cold-cathode fluorescent lamp, the inverter circuit provides two outputs different in phase by 180 degrees. In this case, however, the two outputs of opposite phases of the inverter circuit should not necessarily become uniform.

With nonuniform outputs, the voltage applied to the electrode on one side of the cold-cathode fluorescent lamp becomes greater, while the voltage applied to the electrode on the other side of the cold-cathode fluorescent lamp becomes lower, making the loads on the outputs of the inverter circuit uneven. Such biasing of outputs is likely to occur when the power factor as seen from the primary side of the step-up transformer is improved and the copper loss is reduced by using the leakage flux transformer in the step-up transformer and causing resonation of the leakage inductance of the leakage flux transformer and the capacitive component of the secondary circuit.

The technique of achieving high efficiency of an inverter circuit using the resonance technique is disclosed in U.S. Pat. No. 5,495,405 by one of the inventors of the present invention. That is, biasing of outputs is hard to occur in a conventional inverter circuit which uses a non-leakage flux transformer having a low leakage inductance as the step-up transformer at the output stage and uses a ballast capacitor to stabilize the lamp current. The biasing of outputs is a particular phenomenon which occurs when a scheme of acquiring a high efficiency is performed by working out the invention in U.S. Pat. No. 5,495,405.

When an inverter circuit has two outputs whose output voltages differ in phase from each other by 180 degrees, a resonance circuit is constructed for each of the outputs of opposite phases as shown in FIG. 13. When the two resonance circuits are constructed not in association with each other, the resonance frequencies of the resonance circuits should not necessarily match with each other.

If the resonance frequencies of the resonance circuits do not match with each other, as shown in FIG. 14, the step-up ratios of the outputs of the inverter circuit differ even when the resonance circuits are driven with the same frequency, thus making the voltages to be applied to the electrodes of the cold-cathode fluorescent lamp different from each other. As a result, the outputs of the inverter circuit are unbalanced.

The unbalance is originated from the difference in the resonance frequencies of the outputs of opposite phases caused by the difference in leakage inductances of the leakage flux transformers to be used at the outputs of the inverter circuit or the difference in capacitive components of the secondary circuit.

In an actual surface light source system, a current distributor module is connected to each electrode of the cold-cathode fluorescent lamp or the size precisions of the cold-cathode fluorescent lamp and the reflector which includes the effect as a proximity conductor vary, thus causing considerable unbalance of parasitic capacitances.

There are fluctuations in leakage inductances of the leakage flux transformers, which are the cause of making the resonance frequencies of the resonance circuits unmatched with each other.

When the resonance frequencies do not match with each other, the outputs become unbalance so that the electrodes on both sides of the cold-cathode fluorescent lamp cannot be driven uniformly. As a result, excessive power concentration occurs on one output, leading to nonuniform heat generation of the inverter circuit.

To prevent the biasing of outputs, the resonance frequencies of the resonance circuits for the outputs of opposite phases should be made uniform.

The following will discuss the problem of the prior art from viewpoint of static noise.

To reduce static noise, it is effective to cancel static noise by driving adjoining cold-cathode fluorescent lamps with outputs of opposite phases. FIGS. 15 to 17 show examples of the structure. To drive cold-cathode fluorescent lamps in the mentioned manner, a single transformer having outputs of opposite phases is provided for every set of two cold-cathode fluorescent lamps which are driven in opposite phases.

In the example shown in FIG. 15, however, the electrodes on one side of adjoining cold-cathode fluorescent lamp become high potentials of opposite phases while the other electrodes are at the GND (ground) potential. In this case, the presence of the leak current flowing via a parasitic capacitor Csm produced between the adjoining cold-cathode fluorescent lamps on the high-voltage side makes nonuniform brightness worse than the single-side high voltage driving system in the case shown in FIG. 18. This undesirably requires that the backlight with such a structure should be driven with a relatively low frequency.

One solution to this problem is to realize double-side high voltage driving by driving a single cold-cathode fluorescent lamp with a single transformer as shown in FIG. 16.

Because multiple high-voltage lines run across in the casing of the surface light source according to the method, however, the parasitic capacitance becomes unbalanced.

In addition, the individual cold-cathode fluorescent lamps are alternately driven in opposite phases, thus requiring more transformers than the structure shown in FIG. 15.

The structure shown in FIG. 17 has a greater number of transformers to prevent high-voltage crossover lines so that the transformers are arranged on both sides of the cold-cathode fluorescent lamps to achieve double-side high voltage driving, and changes the phase of the drive voltage for every other cold-cathode fluorescent lamp to reduce static noise. The structure apparently needs a significant number of transformers and control circuits.

Although a switching circuit and a control circuit are not shown in FIGS. 16 and 17, the actual inverter circuit system for a liquid crystal display television has additional circuits of detecting the lamp currents of the individual cold-cathode fluorescent lamps and controlling the respective cold-cathode fluorescent lamps, the inverter circuit has a very large scale.

None of the circuits shown in FIGS. 15 to 17 do not solve the problem of the outputs being unbalanced due to the deviation of the resonance frequency of the secondary circuit.

In view of the above, there has been demands for a low-cost surface light source system and an inverter circuit for multiple lamps, which reduces nonuniform brightness and static noise, and fulfills the requirement that lamp currents of individual cold-cathode fluorescent lamps should be uniform and stabilized.

SUMMARY OF THE INVENTION

Accordingly, it is an object of the present invention to realize balanced power consumption of outputs of opposite phases of an inverter circuit, which has two resonance circuits and has outputs of opposite phases, by balancing biasing of the drive power generated by the deviation of the resonance frequencies of the resonance circuits to thereby match the resonance frequencies with each other by connecting a shunt transformer with a high winding breakdown voltage between the inverter circuit and each cold-cathode fluorescent lamp, when the cold-cathode fluorescent lamps are driven by the double-side high voltage driving system using the inverter circuit.

It is another object of the present invention to realize an inverter circuit system with a simple structure by designing a shunt circuit by combination of a shunt transformer having a high winding breakdown voltage with a current distributor module, in a surface light source system for multiple lamps which makes the brightness of the cold-cathode fluorescent lamp uniform by driving the cold-cathode fluorescent lamp by the double-side high voltage driving system and cancels and reduces static noise by driving adjoining cold-cathode fluorescent lamps in opposite phases.

It is a further object of the present invention to realize a low-cost surface light source system for multiple lamps which drives the lamps by the double-side high voltage driving system and reduce static noise while making the lamp currents of the individual cold-cathode fluorescent lamps uniform and stable by combining the two techniques mentioned above.

It is a still further object of the present invention to realize a low-cost surface light source system for multiple lamps, which couples adjoining cold-cathode fluorescent lamps at the low-voltage ends by a shunt transformer in the single-side high voltage driving system, thereby canceling static noise.

DETAILED DESCRIPTION OF THE PREFERRED EMBODIMENTS

The present invention will be described below with reference to the accompanying drawings.

Figure 1:
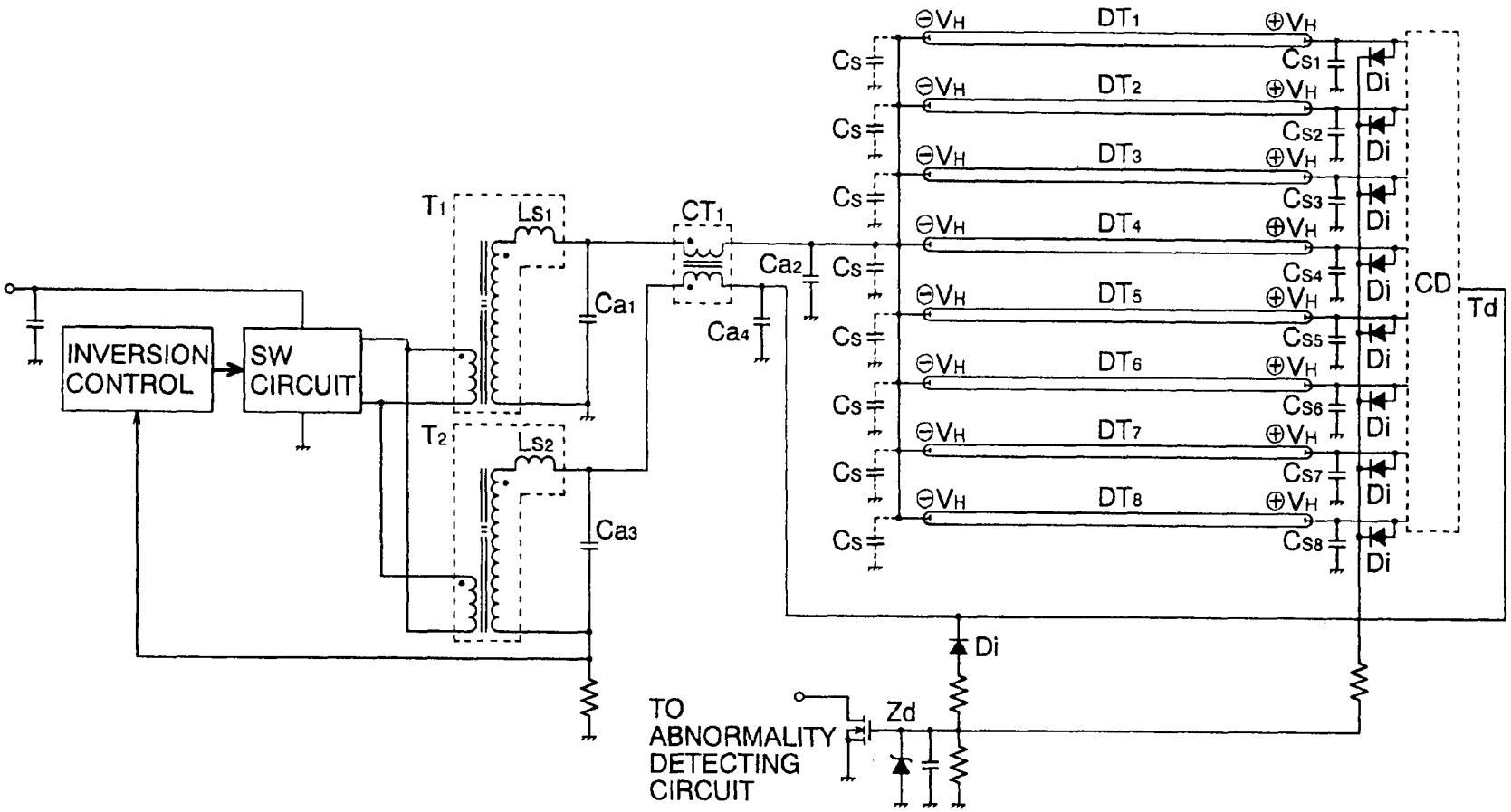
FIG. 1 is a circuit structural diagram of a double-side high voltage driving system, illustrating one embodiment of the present invention.

FIG. 1 is a circuit structural diagram of a double-side high voltage driving system, illustrating one embodiment of the present invention, where an inversion control circuit and a switching (SW) circuit are an oscillation circuit for an inverter circuit and a drive circuit for a step-up transformer. All the inverter circuits that are generally used can be adapted.

T1 and T2 show leakage flux step-up transformers having leakage inductances (JIS) $Ls_1$ and $Ls_2$ in terms of an equivalent circuit. In circuit diagrams which are to be illustrated simply, the leakage inductance (JIS) Ls may be omitted from the description. Although such a description is not correct one based on the ISO description, it is often customary to make such omission among those skilled in the related art.

$Cw_1$ and $Cw_2$ are parasitic capacitances between windings, and $Ca_1$, $Ca_2$, $Ca_3$ and $Ca_4$ are auxiliary capacitances to be added in an auxiliary fashion as needed. There is a parasitic capacitance Cs around the cold-cathode fluorescent lamp. The combined capacitance of those capacitances constitutes the secondary capacitive component. Those capacitive components, together with the leakage inductances $Ls_1$ and $Ls_2$, constitute two resonance circuits.

The auxiliary capacitances $Ca_1$, $Ca_2$, $Ca_3$ and $Ca_4$ serve to adjust the resonance frequencies of the resonance circuits. $CT_1$ is a shunt transformer which couples the two resonance circuits. The shunt transformer $CT_1$ is connected in such a way that magnetic fluxes generated by the currents that flow in the individual windings face and cancel out each other. CD is a current distributor module.

Figure 2:
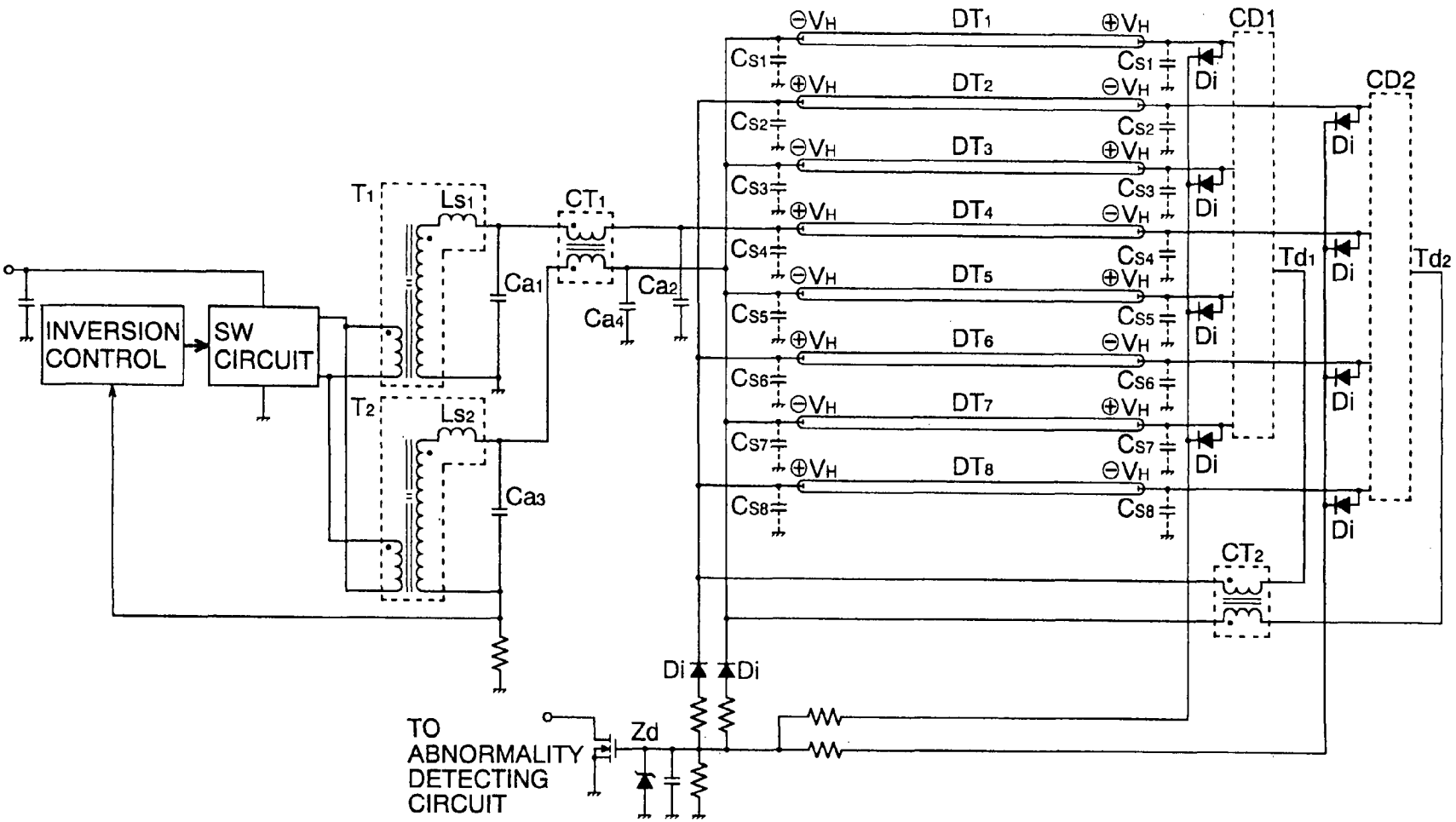
FIG. 2 is a circuit structural diagram of another embodiment of the present invention wherein a connection method of alternately driving every other cold-cathode fluorescent lamps in opposite phases is adapted to the first embodiment of the present invention.

FIG. 2 shows an embodiment where the structure shown in FIG. 1 is modified in such a way that the phases are reversed every other cold-cathode fluorescent lamp to cancel out static noise. $DT_1$ to $DT_8$ are cold-cathode fluorescent lamps separated into two groups and are integrated by current distributor modules CD1 and CD2. The terminals, $Td_1$ and $Td_2$, of the current distributor modules CD1 and CD2 are connected to another shunt transformer $CT_2$ in such a way as to balance the currents to be supplied to the two current distributor modules CD1 and CD2.

The current distributor modules CD1 and CD2 are what is disclosed as the invention in U.S. Laid-Open Patent Publication No. 2004-0155596-A1 by one of the present inventors.

Figure 3:
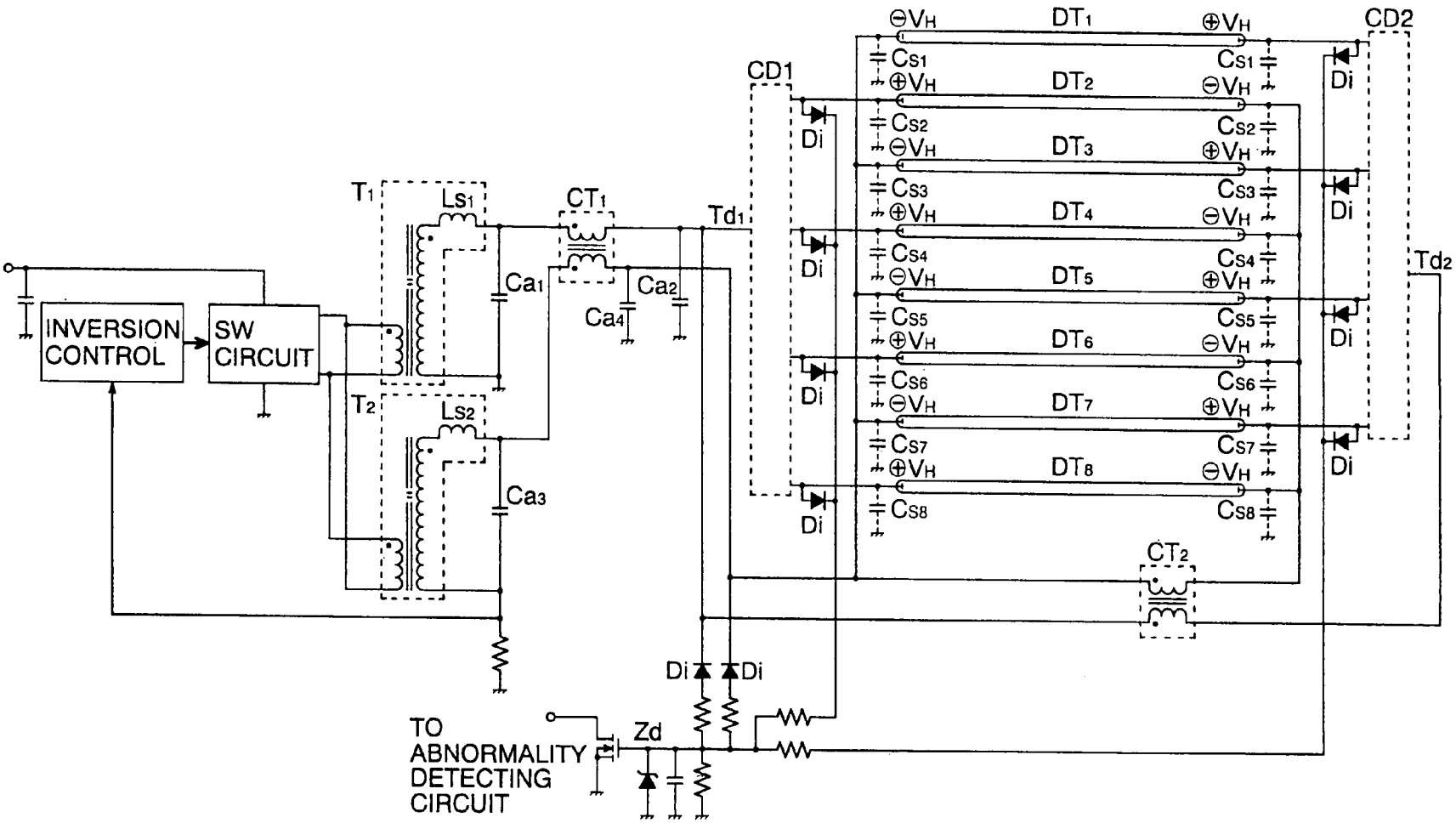
FIG. 3 is a circuit structural diagram showing a different embodiment of the present invention.

FIG. 3 shows a different embodiment where the connection method for the current distributor modules CD1 and CD2 is modified; specifically, the current distributor modules are separated into two substrates and constitute two groups consisting of the current distributor modules CD1 and CD2. Their basic operations are the same as that of the embodiment shown in FIG. 2, so that this embodiment is one of feasible embodiments.

Referring to FIGS. 1 to 3, when the sum of the parasitic capacitances $Cs_1$ to CSn which are produced around the cold-cathode fluorescent lamps differs between the integrated cold-cathode fluorescent lamps of the two current distributor modules CD1 and CD2, the unmatching of the parasitic capacitances can be corrected by adequately changing the layout of the auxiliary capacitances $Ca_1$, $Ca_2$, $Ca_3$ and $Ca_4$ for adjusting the resonance frequencies.

If the auxiliary capacitances $Ca_1$, $Ca_2$, $Ca_3$ and $Ca_4$ are laid in such a way that the currents flowing in the windings of the shunt transformer $CT_1$ become nearly uniform, the magnetic flux generated in the core of the shunt transformer $CT_1$ mostly disappears, so that the shunt transformer $CT_1$ can be very small.

As the shunt transformer $CT_1$ is normally arranged on the inverter circuit substrate side, it particularly needs to be small. As the outputs of opposite phases of the inverter circuit of the double-side high voltage driving type are connected to the shunt transformer $CT_1$, a very high winding breakdown voltage is required.

Figure 4:
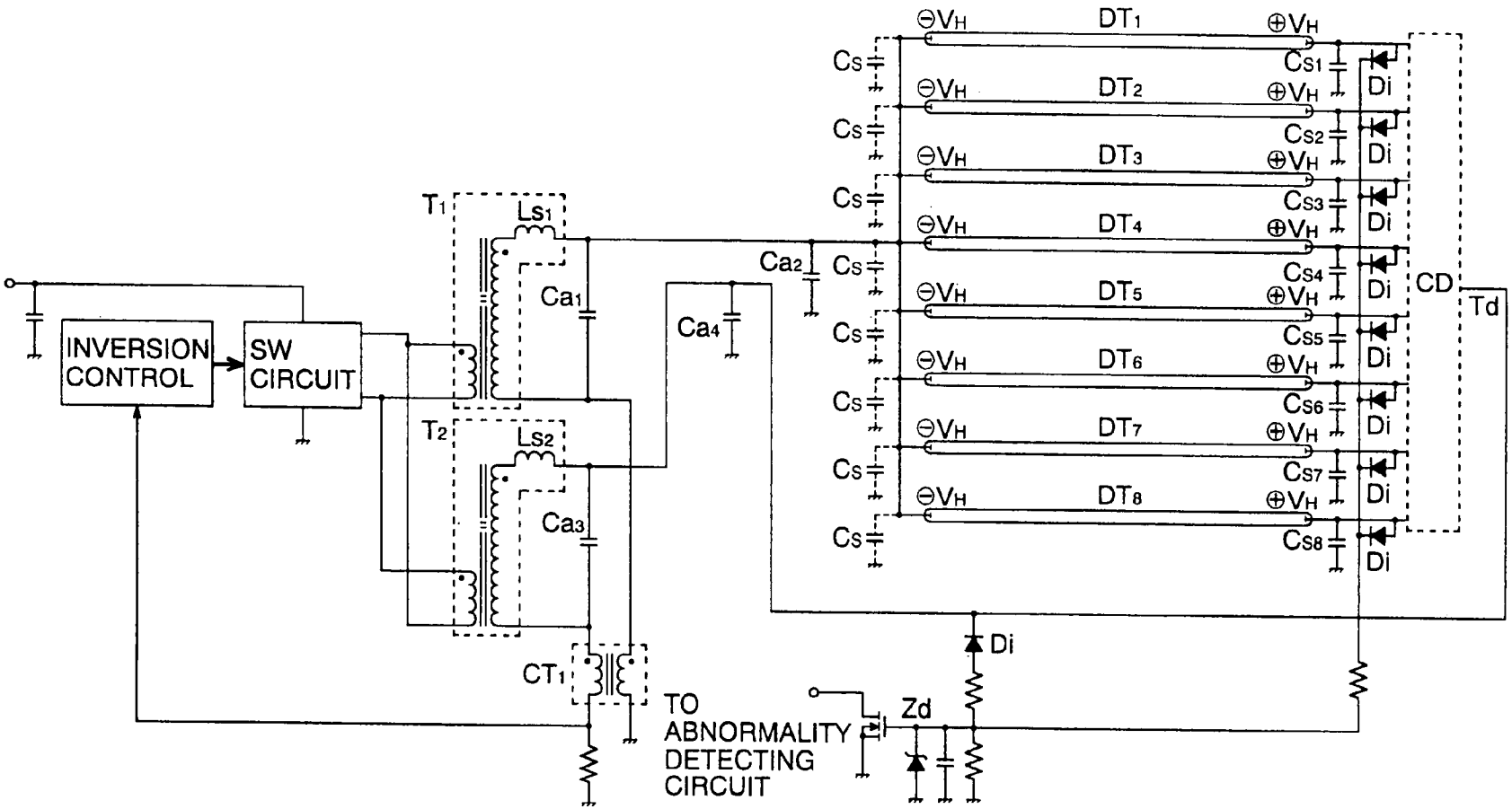
FIG. 4 is a circuit structural diagram showing a further embodiment of the present invention.

If the shunt transformer $CT_1$ is connected to GND via the GND sides of step-up transformers T1 and T2 as shown in FIG. 4, the required breakdown voltage of the shunt transformer $CT_1$ should not be so high. Like the embodiments in FIGS. 1 through 3, the embodiment in FIG. 4 is one of feasible embodiments.

Figure 5:
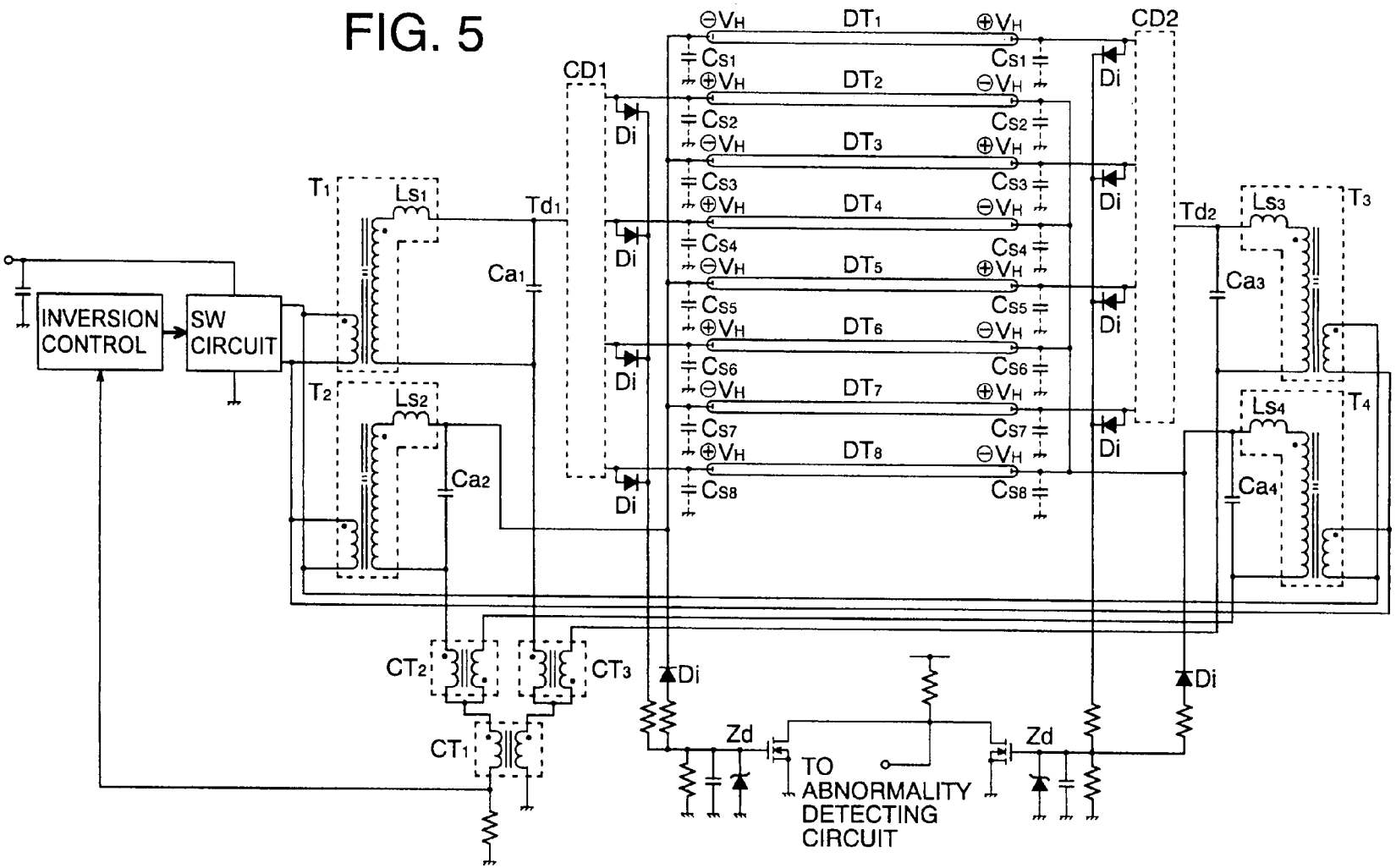
FIG. 5 is a circuit structural diagram showing a still further embodiment of the present invention.

When step-up transformers are laid out on both sides in the double-side high voltage driving system as shown in FIG. 5, lower-voltage ones of the four step-up transformers $T_1$ to $T_4$ which have outputs of the same phase, i.e., the step-up transformers $T_1$ and $T_3$, may be connected to the shunt transformer $CT_2$, and the step-up transformers $T_2$ and $T_4$ may be connected to the shunt transformer $CT_3$ to balance out, and the resultant arrangement may be further balanced by the shunt transformer $CT_1$. This modification is also one of feasible embodiments.

The current distributor modules CD1 and CD2 may be accommodated in the backlight as a single independent module. When the current distributor module is accommodated in the backlight, the maximum number of lines to be led out from the backlight is four, thus simplifying the structure of the backlight.

As the step-up transformers and the low-voltage shunt transformers are connected in the above manner, high-voltage crossover lines running across the circuit are eliminated even in a large backlight, thus simplifying the processing of high-voltage lines. For the low-voltage shunt transformers, there are multiple ways of achieving equivalent balancing and shunting effect as in the invention disclosed in U.S. Laid-Open Patent Publication No. 2004-0155596-A1, and any of the connection methods may be employed in this embodiment.

Figure 15:
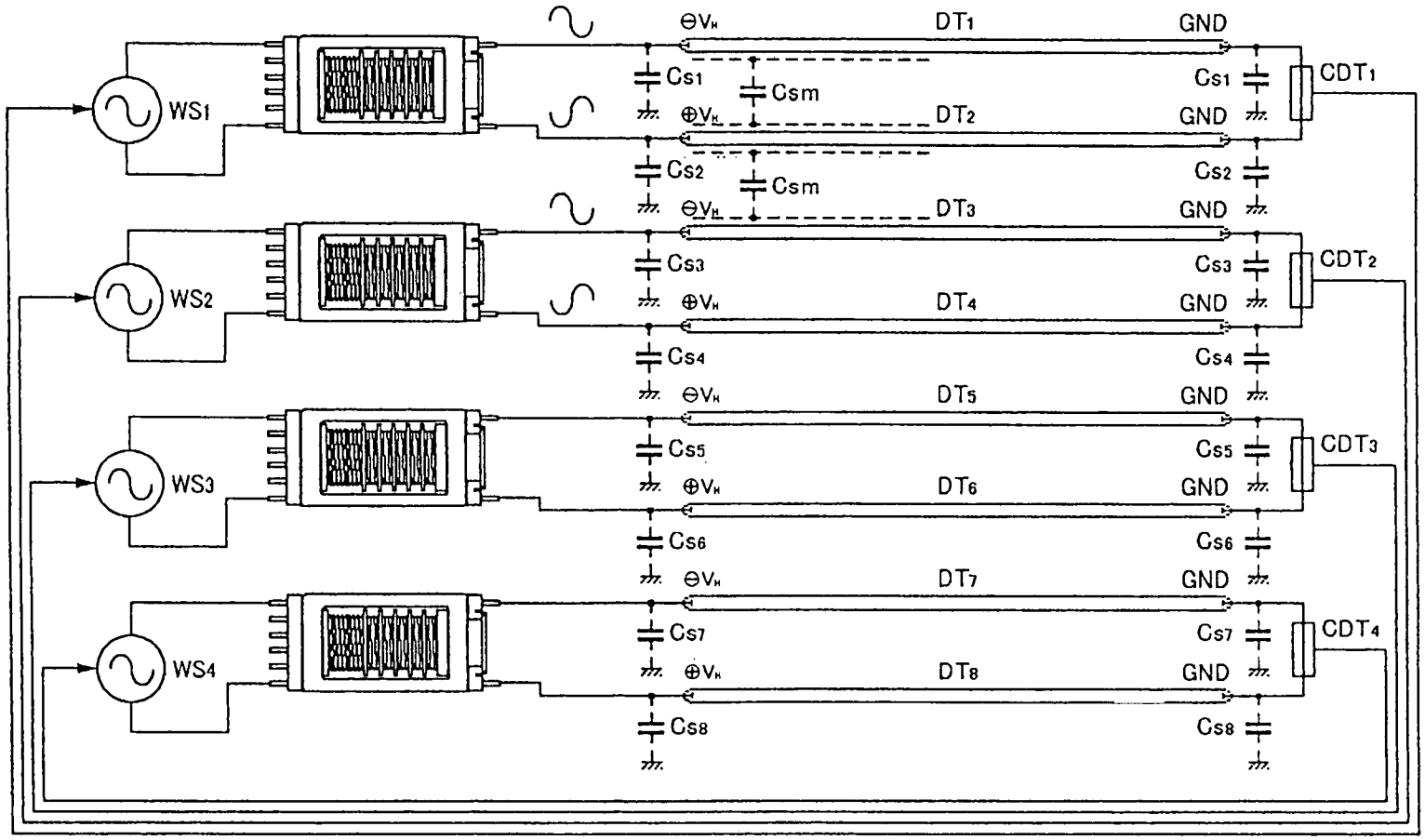
FIG. 15 is a circuit structural diagram showing one example of canceling static noise generated from a cold-cathode fluorescent lamp in the conventional single-side high voltage driving system.
Figure 16:
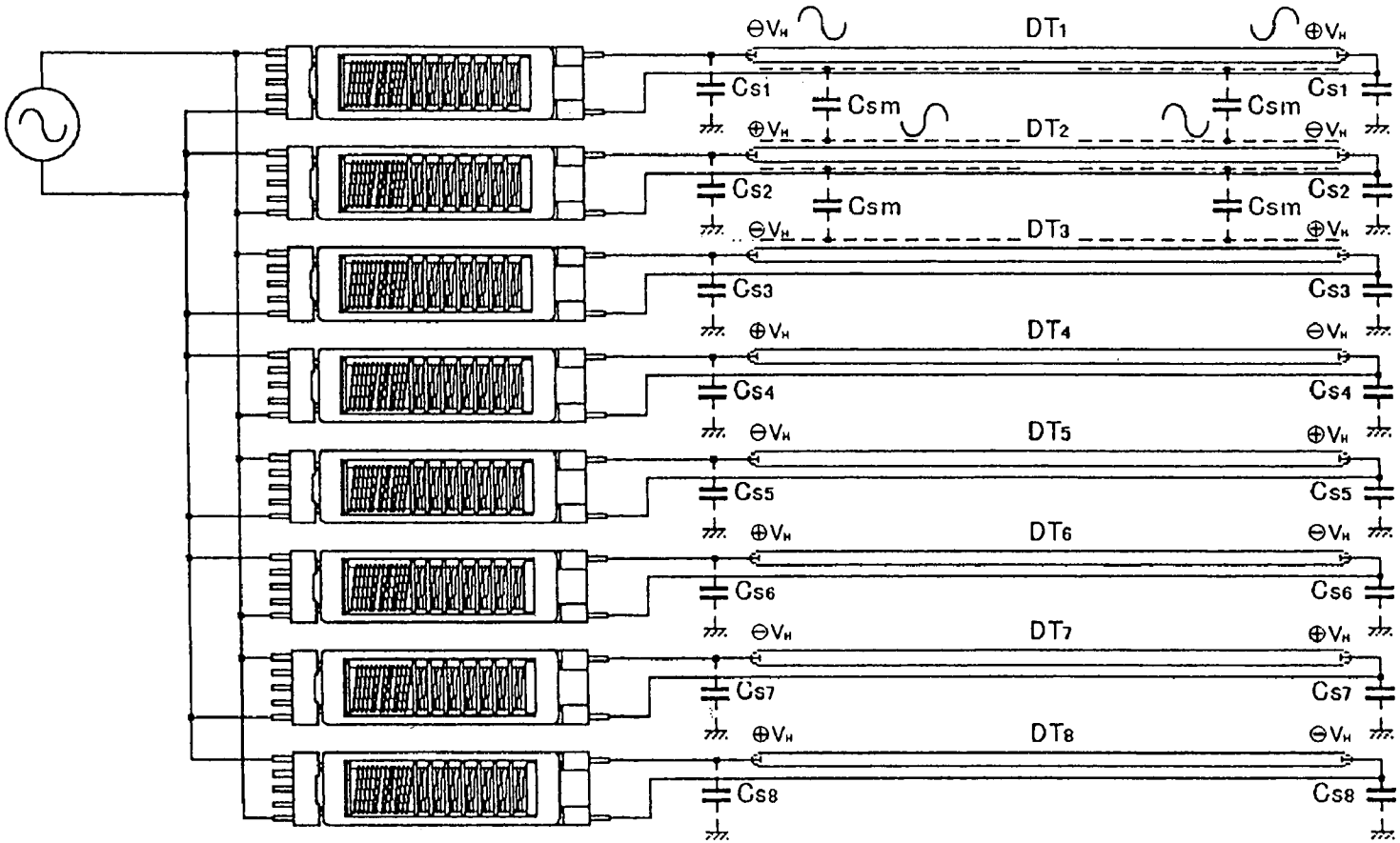
FIG. 16 is a circuit structural diagram showing another example of canceling static noise generated from a cold-cathode fluorescent lamp in the conventional double-side high voltage system.

When one wants to go after overall cost reduction of the system, the current detection means CDT in FIG. 15, which is of the single-side high voltage driving type, can be made to bring about the balancing and shunting effect too.

Figure 6:
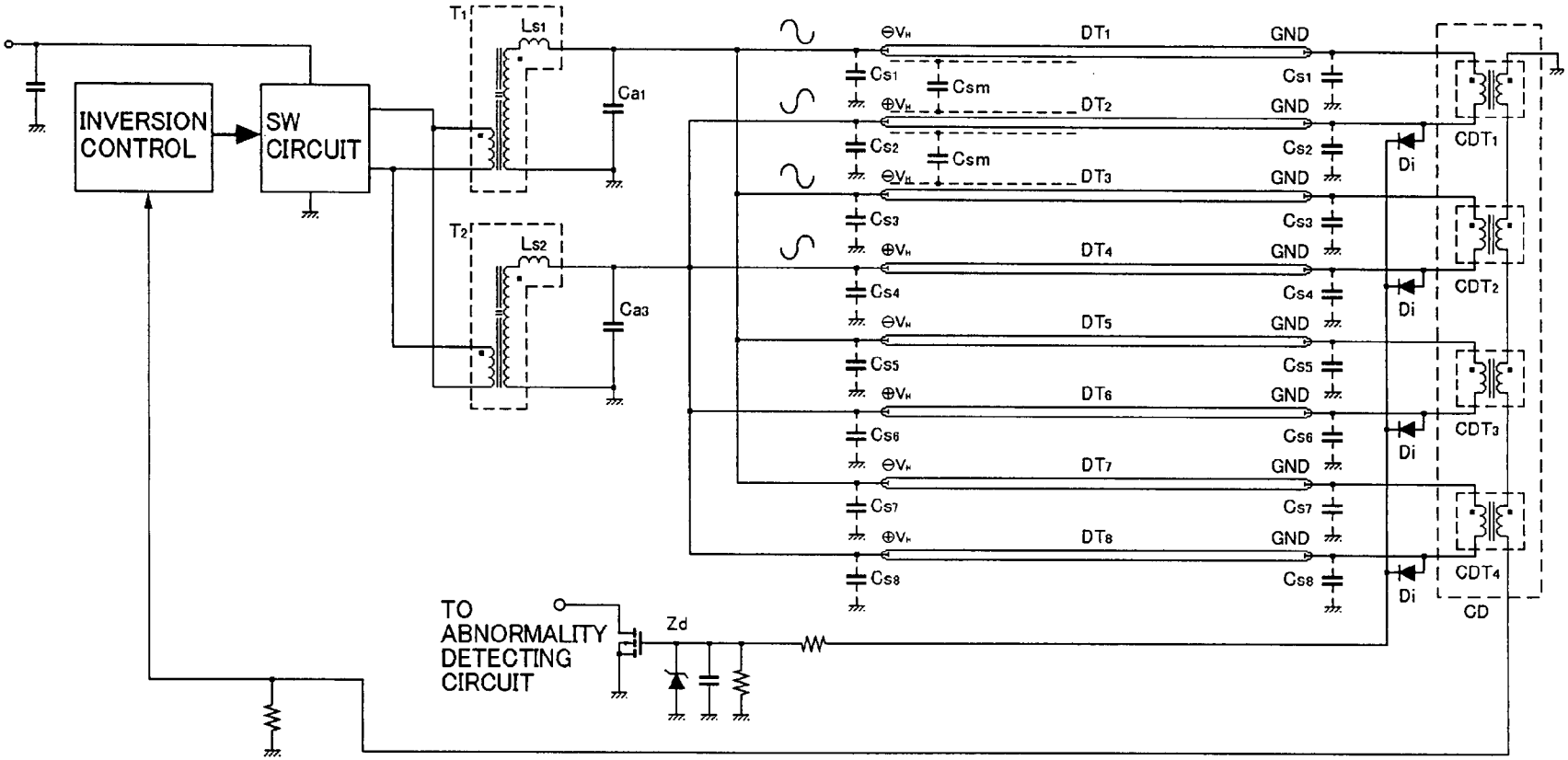
FIG. 6 is a circuit structural diagram showing a yet still further embodiment of the present invention.

FIG. 6 is an explanatory diagram illustrating the structure of one of feasible embodiments of the modification where two resonance circuits are balanced by balancing and shunting a pair of cold-cathode fluorescent lamps for each shunt transformer.

It is to be noted however that the shunt transformers $CDT_1$ to $CDT_4$ to be used in this case require very large mutual inductances (specifically, twice as high or higher), so that to secure large mutual inductance values, keep a high self resonance frequency and design the circuit compact, a specific winding method, such as oblique winding disclosed in U.S. Laid-Open Patent Publication No. 2004-0155596-A1 by one of the present inventors, or the section winding disclosed in Japanese Patent Application No. 2004-254129, is essential. It has been confirmed that the requirements could not be fulfilled by a shunt transformer constructed by the stacked winding disclosed as a conventional method at least in Japanese Patent Application No. 2004-254129.

The above connection method requires just a single feedback circuit for the lamp current. Because the current distributor modules $CDT_1$ to $CDT_4$ can be accommodated in the backlight panel as a single independent module, running of high-voltage lines can be made very simple.

Figure 7:
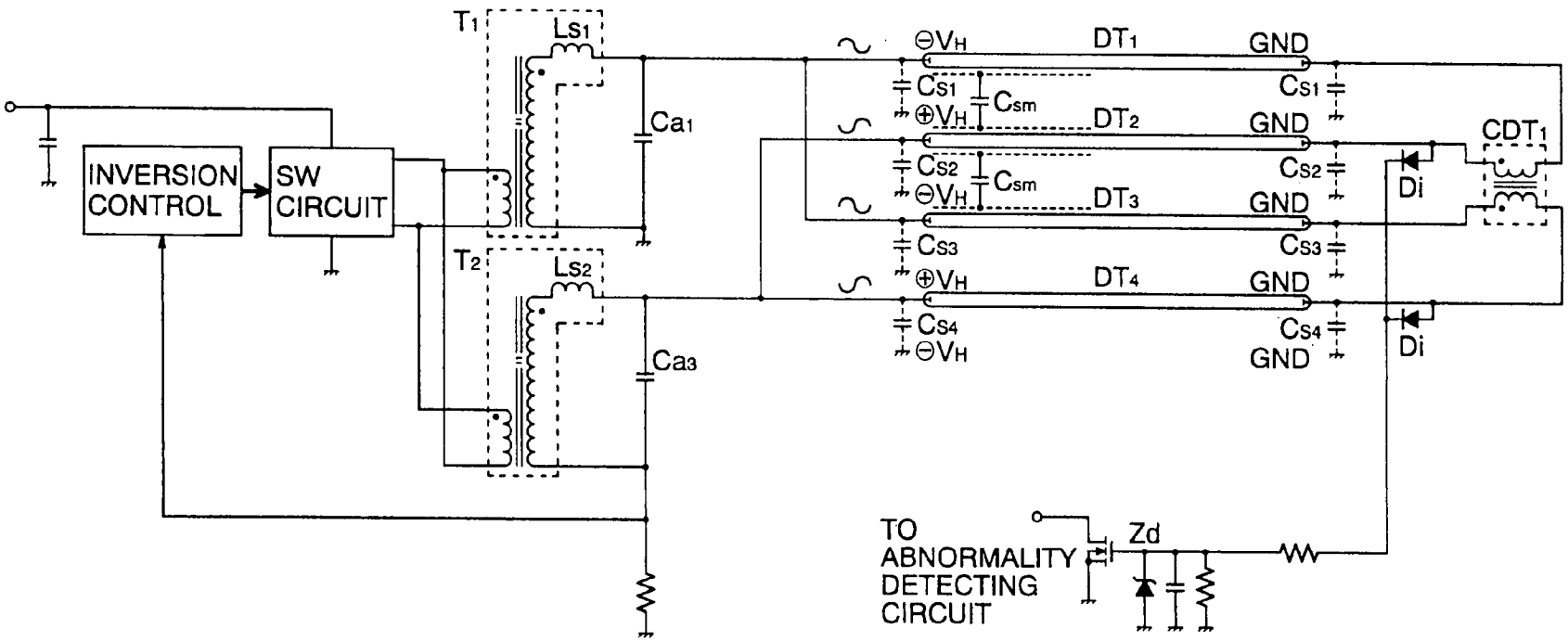
FIG. 7 is a circuit structural diagram showing a yet still further embodiment of the present invention.

FIG. 7 is an explanatory diagram illustrating the structure of a further embodiment where four lamps are balanced and shunted by a single shunt transformer to balance two resonance circuits. Four lamps are balanced by the single shunt transformer $CDT_1$. Although the detection of the lamp current in this case is done on the GND side of the secondary winding of the step-up transformer, the detection may be carried out by a separate current transformer further provided, or by a light-emitting diode and a phototransistor.

Figure 8:
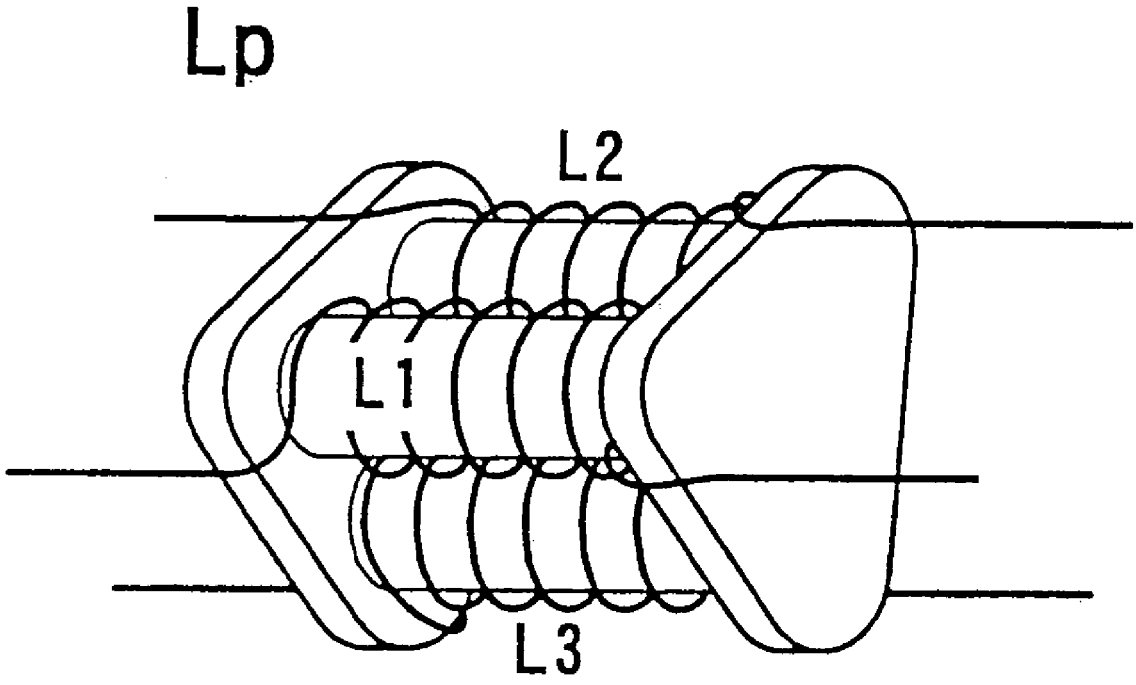
FIG. 8 is an explanatory diagram showing one example of a 3-way shunt transformer according to the present invention.
Figure 9:
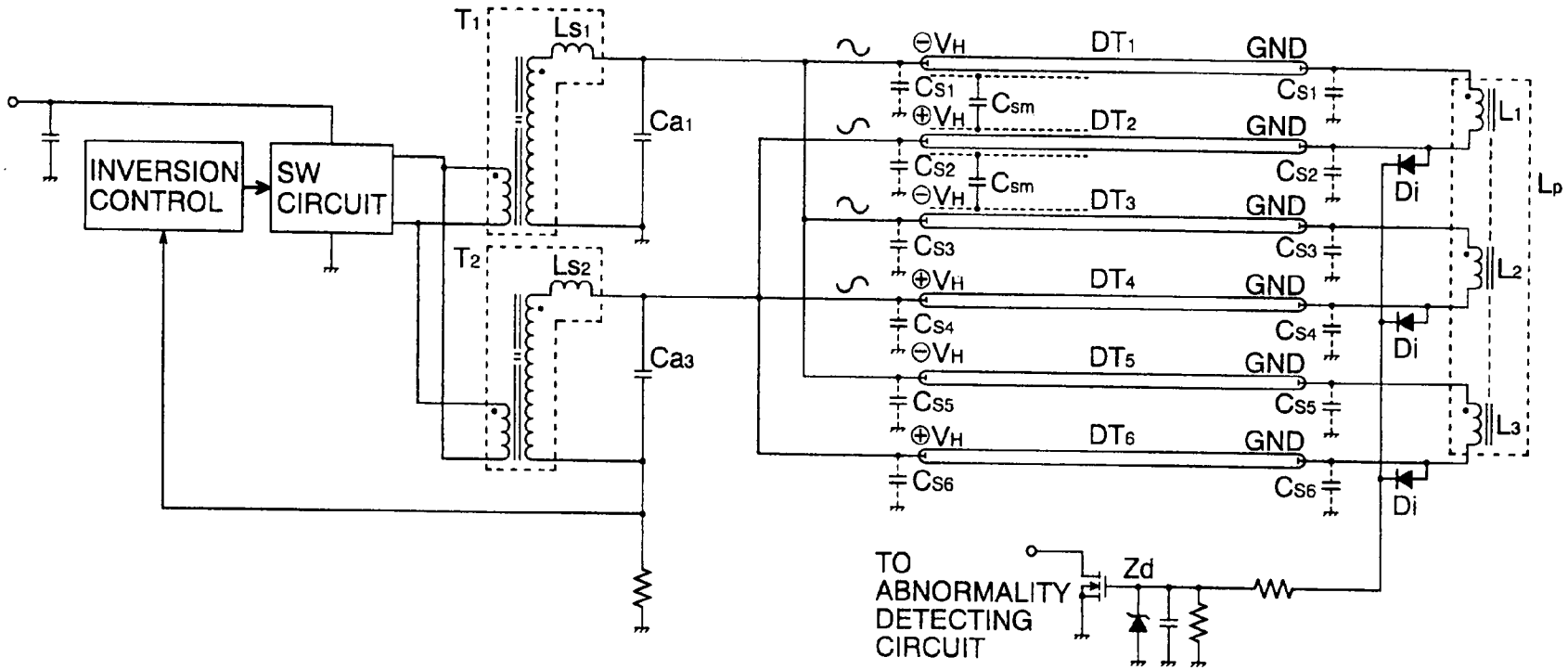
FIG. 9 is a circuit structural diagram showing a yet still further embodiment of the present invention which uses a 3-way shunt transformer of the present invention.

FIG. 9 shows a still further embodiment where the shunt transformer $CDT_1$ is replaced with a 3-way shunt transformer Lp in FIG. 6 disclosed in U.S. laid-Open Patent Publication No. 2004-0155596-A1 (FIG. 8 in the present specification).

FIG. 9 is an explanatory diagram illustrating the structure that balances and shunts six lamps using a 3-way shunt transformer to balance two resonance circuits. If the 3-way shunt transformer is replaced with a shunt transformer for multiple lamps, a greater number of lamps can be balanced and shunted.

(Operation)

The operation of a surface light source system for lighting multiple lamps according to the present invention will be described below.

Figure 13:
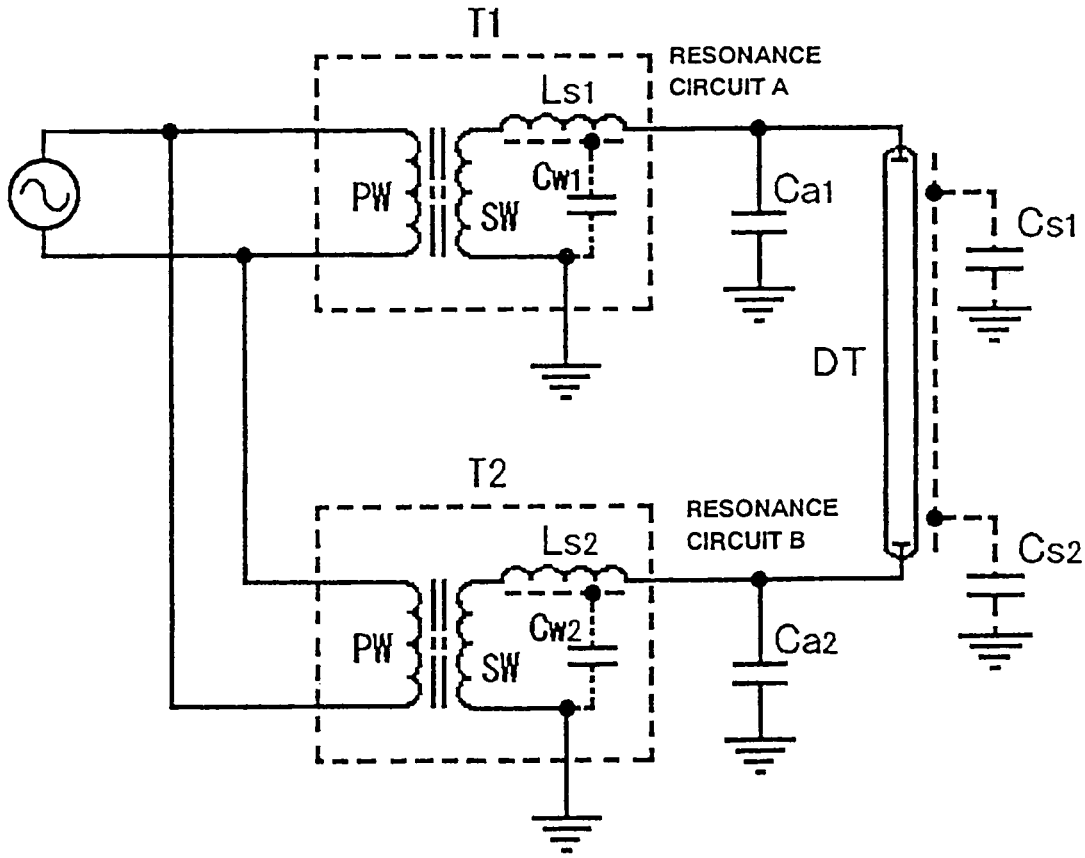
FIG. 13 is an exemplary diagram illustrating the work of two resonance circuits in a system of driving both ends of a conventional cold-cathode fluorescent lamp with high voltages of opposite phases.
Figure 14:
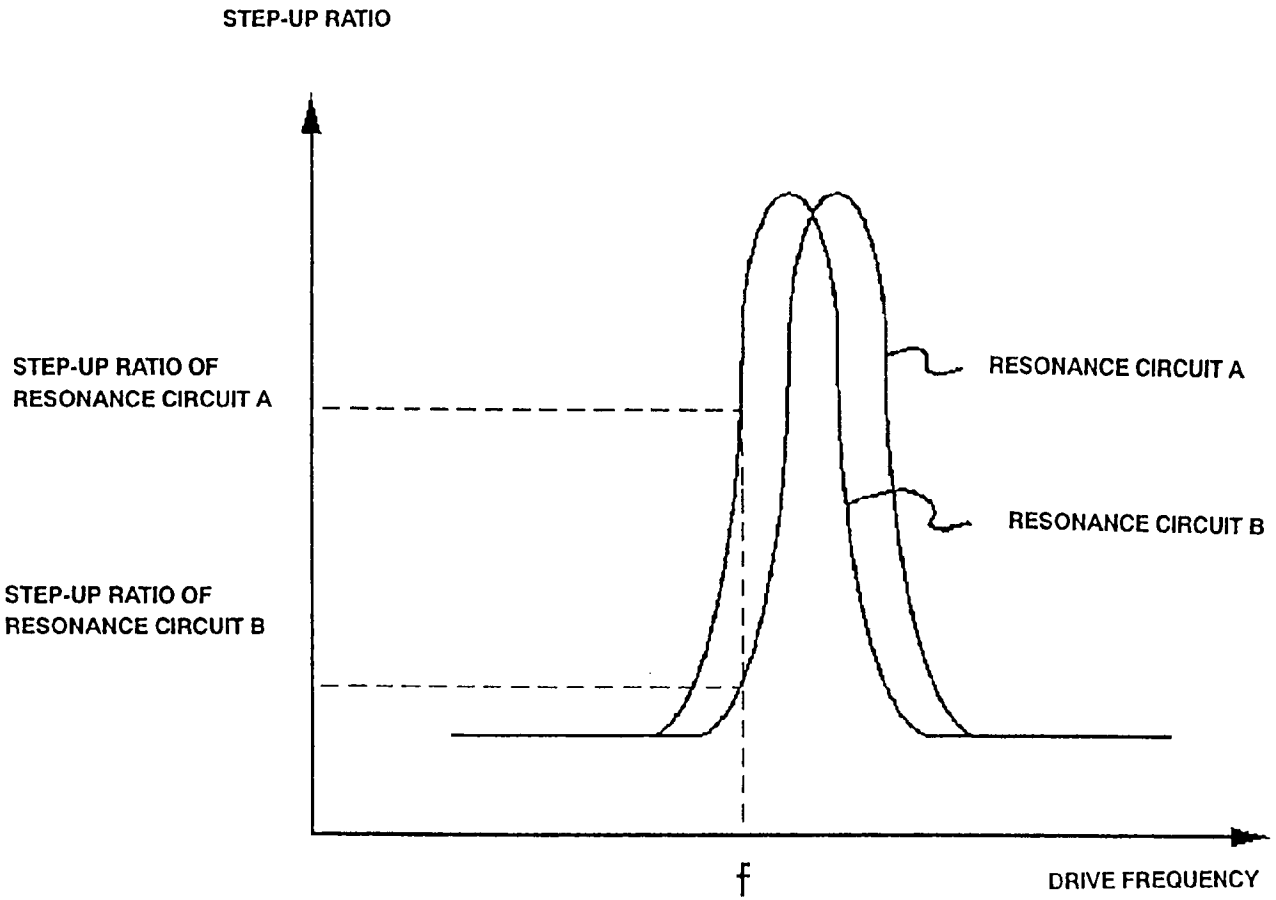
FIG. 14 is a drive frequency v.s. step-up ratio graph for explaining states where the step-up ratio of the outputs differs according to the unmatched resonance frequency in the circuit structure shown in FIG. 12.

In an inverter circuit having two outputs of opposite phases, the resonance circuit that is constituted by a leakage inductance and the capacitive component of the secondary circuit is exemplarily illustrated in FIG. 13.

Referring to FIG. 13, T1 and T2 are leakage flux transformers, and $Ls_1$ and $Ls_2$ are leakage inductances of the leakage flux transformers. The "leakage inductance" here is a so-called JIS leakage inductance which is measured from the secondary winding side when the primary side of the transformer is short-circuited.

The value of the leakage inductance of the leakage flux transformer is such that when the reactance at the operational frequency of the inverter circuit is around 60% of the impedance of the discharge lamp DT as a load, the power factor improving effect is demonstrated, thereby improving the conversion efficiency of the inverter circuit. This effect is disclosed in U.S. Pat. No. 5,495,405 by one of the present inventors.

On the transformer T1 side in FIG. 13, $Ls_1$ is the inductive component and the sum of a winding parasitic capacitance $Cw_1$, an auxiliary capacitance $Ca_1$ and a parasitic capacitance $Cs_1$ around the discharge lamp constitutes the secondary capacitive component, and those inductive component and capacitive component constitute one series resonance circuit. Such a resonance circuit is also present on the transformer T2 side, in which an inductive component $Ls_2$ and capacitive components $Cw_2$, $Ca_2$ and $Cs_2$ constitute the other series resonance circuit. In this case, the two resonance circuits are independent of each other and the resonance frequencies of the resonance circuits should not necessarily match with each other.

When the shunt transformer $CT_1$ is connected between the two resonance circuits and the load as shown in FIG. 1, the following operation takes place.

The shunt transformer $CT_1$ in FIG. 1 is a shunt transformer having two windings of the same value.

It is assumed that the shunt transformer $CT_1$ is connected in such a way that magnetic fluxes which are generated by the currents flowing in the loads $DT_1$ to $DT_8$ face each other. In this case, the generated magnetic fluxes are mostly canceled out, so that only a slight voltage is produced on the windings of the shunt transformer $CT_1$.

When the resonance frequencies of the two resonance circuits differ from each other and the currents flowing in both electrodes of the cold-cathode fluorescent lamp differ from each other, the currents that flow in the shunt transformer tend to be uniform due to the operation discussed below.

If the current in one of the electrodes of the cold-cathode fluorescent lamp increases and the other current decreases, the magnetic fluxes of the shunt transformer become unbalanced, leaving a magnetic flux which cannot be canceled out. This magnetic flux works in the shunt transformer $CT_1$ in the direction of decreasing the current with respect to that electrode whose current is larger and works in the direction of increasing the current with respect to that electrode whose current is smaller, balancing the currents at both electrodes of the cold-cathode fluorescent lamp.

This function of the shunt transformer $CT_1$ works not only on the resistance component of the cold-cathode fluorescent lamp but also on the capacitive component. That is, coupling of capacitive components is achieved through the shunt transformer $CT_1$. As a result, capacitive component which is connected to the shunt transformer $CT_1$ is copied from one winding side to the other winding side. In the case where the shunt transformer is an ideal transformer, therefore, there is no significant difference when the capacitive component is coupled to either winding side of the shunt transformer.

Further, not only the capacitive component, but also the inductive component, specifically, the leakage inductance, is copied. Consequently, the two resonance circuits are coupled and the resonance frequencies match with each other.

When the currents flowing across the coils of the shunt transformer $CT_1$ are uniform, the magnetic fluxes generated in the core of the shunt transformer $CT_1$ are canceled out, so that no magnetic flux, except for the residual component, is not produced. This can make the core smaller and eliminates most of the voltage generated in the shunt transformer $CT_1$.

Actually, the current distributor module is connected to each electrode side of a cold-cathode fluorescent lamp in the surface light source system, and the parasitic capacitance between the cold-cathode fluorescent lamp and the reflector which includes the effect as a proximity conductor is unbalanced.

Because the leakage inductance of the leakage flux transformer is not quite uniform, a magnetic flux which is not canceled out remains in the shunt transformer $CT_1$, producing a voltage in the shunt transformer. The uncanceled magnetic flux should be made as small as possible.

The resonance capacitors $Ca_1$ to $Ca_4$ located before and after the shunt transformer $CT_1$ are intended to correct the unbalance.

When the resonance capacitors $Ca_1$ to $Ca_4$ are adequately laid out so as to adjust the unbalanced capacitance to be small, the currents flowing across the coils of the shunt transformer $CT_1$ can be made almost uniform. In this case, however, the magnetic fluxes generated in the shunt transformer $CT_1$ are mostly canceled out so that the magnetic flux is hardly generated in the core of the shunt transformer $CT_1$.

In the case where the current distributor modules are separated into two groups as shown in FIG. 2, if the individual current distributor modules in each group are simply connected in parallel, the current flows only one current distributor module group. This is because the current distributor module works to bundle multiple cold-cathode fluorescent lamps as if they were a single cold-cathode fluorescent lamp (U.S. Laid-Open Patent Publication No. 2004-0155596-A1), so that the bundled cold-cathode fluorescent lamps also inherit a negative resistance characteristic as a single large cold-cathode fluorescent lamp. To drive those two groups of current distributor modules in parallel, therefore, the current distributor modules should be connected to the inverter circuit via another shunt transformer $CT_2$.

In this case, the shunt transformer $CT_2$ differs from each of current transformers connected in a tournament tree shape in the invention of U.S. Laid-Open Patent Publication No. 2004-0155596-A1 in that a large voltage is applied between the windings of the shunt transformer $CT_2$. Therefore, the winding breakdown voltage of the windings of the shunt transformers $CT_1$ and $CT_2$ should sufficiently endure a voltage twice as high or higher than the output voltage of the inverter circuit.

When one of the coils of the shunt transformer is connected between the low-voltage terminals of a pair of cold-cathode fluorescent lamps as shown in FIGS. 6 and 7, the lamp currents that flow in the pair of cold-cathode fluorescent lamps become approximately identical. This couples the resonance circuits of the inverter circuit having two outputs different in phase from each other by 180 degrees, so that the resonance frequencies become identical.

As apparent from the above, the significant feature of the present invention lies in that the output unbalance which occurs in the combination of the double-side high voltage driving system and a high efficient inverter circuit including two resonance circuits different in phase by 180 degrees on the secondary side of a transformer (U.S. Pat. No. 5,495,405) is corrected by coupling the outputs via a current transformer with a high breakdown voltage to match the resonance frequencies of the resonance circuits with each other.

The present invention has a further significant feature which lies in that an effect similar to the effect of the scheme of canceling static noise to be generated by alternately enabling the voltage of every other electrode of the cold-cathode fluorescent lamp to be driven in the double-side high voltage driving system can be realized with a simple structure by combining a current transformer with a high breakdown voltage and a current distributor module.

Therefore, the invention provides a simple, large-power, high efficient and low-noise surface light source system at a low cost as a backlight for a liquid crystal display television which needs a large surface light source having multiple cold-cathode fluorescent lamps.

As the cost problem that has been the biggest bottleneck in popular usage of cold-cathode fluorescent lamps for the general illumination purpose is eliminated, the use of a large surface light source and a cold-cathode fluorescent lamp for general illumination becomes broader.

As the individual outputs are connected to current transformers and are connected to loads via the current transformers in an inverter circuit having two outputs of opposite phases, the resonance frequencies of the two outputs of opposite phases match with each other. As a result, the condition for the output stages of opposite phases to drive a load becomes uniform, and the loads to be applied to the individual transistors and the individual step-up transformers become uniform.

The brightness of a discharge lamp which is driven by the double-side high voltage driving method become uniform on each electrode side, thus ensuring uniform light emission. This results in an improvement of uniform light emission even for a long cold-cathode fluorescent lamp.

As the advantages of the double-side high voltage driving system are basically not lost at all, the drive frequency can be made higher.

Figure 17:
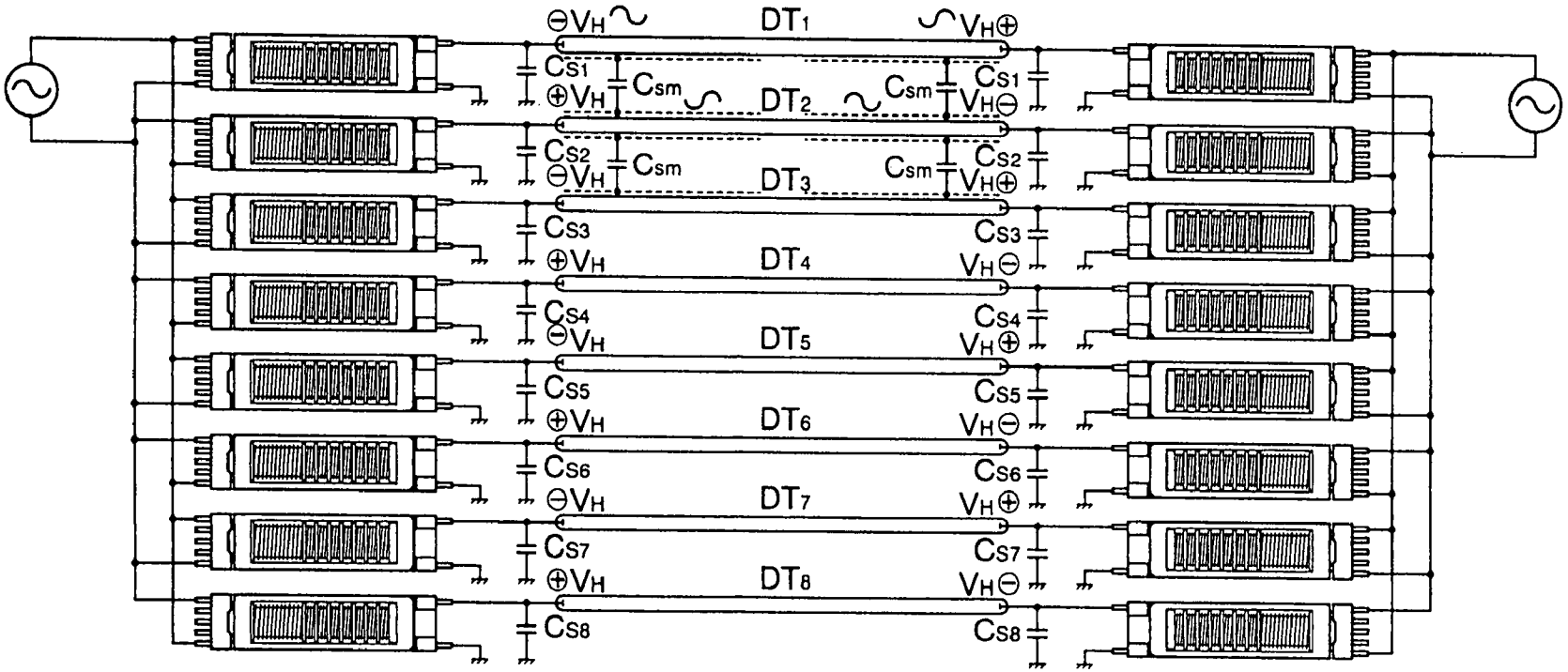
FIG. 17 is a circuit structural diagram showing a different example of canceling static noise generated from a cold-cathode fluorescent lamp in the conventional double-side high voltage system.
Figure 18:
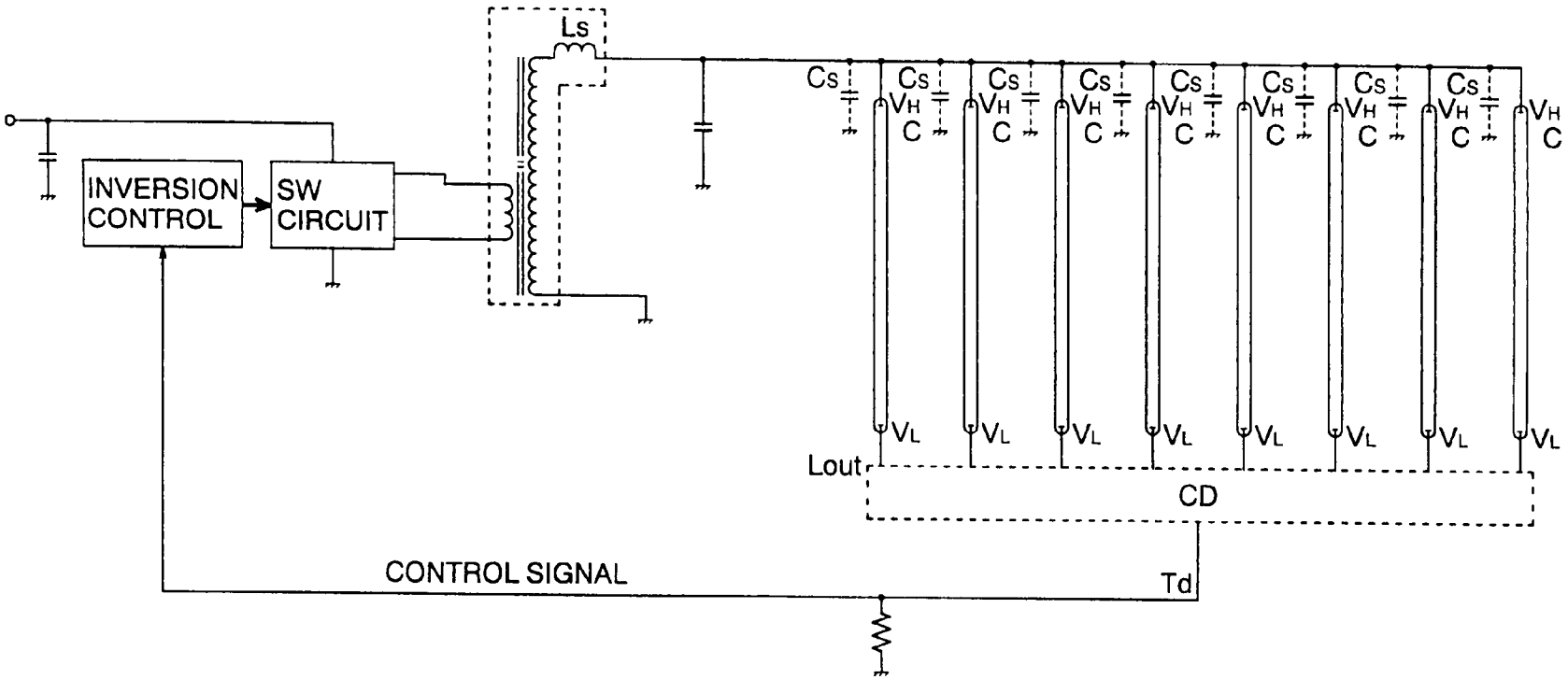
FIG. 18 is a circuit structural diagram showing one example where means of driving multiple cold-cathode fluorescent lamps to be used in a surface light source in parallel to make the lamp currents of the individual discharge lamps uniform is employed in a conventional large surface light source system.

While the means of driving every other one of adjoining cold-cathode fluorescent lamps in opposite phases should conventionally be constructed by using multiple leakage flux transformers as shown in FIG. 17, a backlight system with a very simple structure can be realized by the combination of the current distributor module and the shunt transformer with a high breakdown voltage as shown in FIGS. 2 and 3.

In this case, high-voltage crossover lines can be eliminated by separating the current distributor modules into two groups, making the circuit structure of the double-side high voltage driving system simpler.

Further, when the current distributor modules are accommodated in the backlight, the lines to be led out from the backlight can be reduced significantly, thus simplifying the structure of the backlight.

As the current distributor module should merely have a shunt transformer laid out between cold-cathode fluorescent lamps, a very small substrate will do.

Because the currents flowing across the windings of the shunt transformer can be made uniform by effectively adjusting the resonance capacitors arranged as needed, the shunt transformer can be very small.

Figure 10:
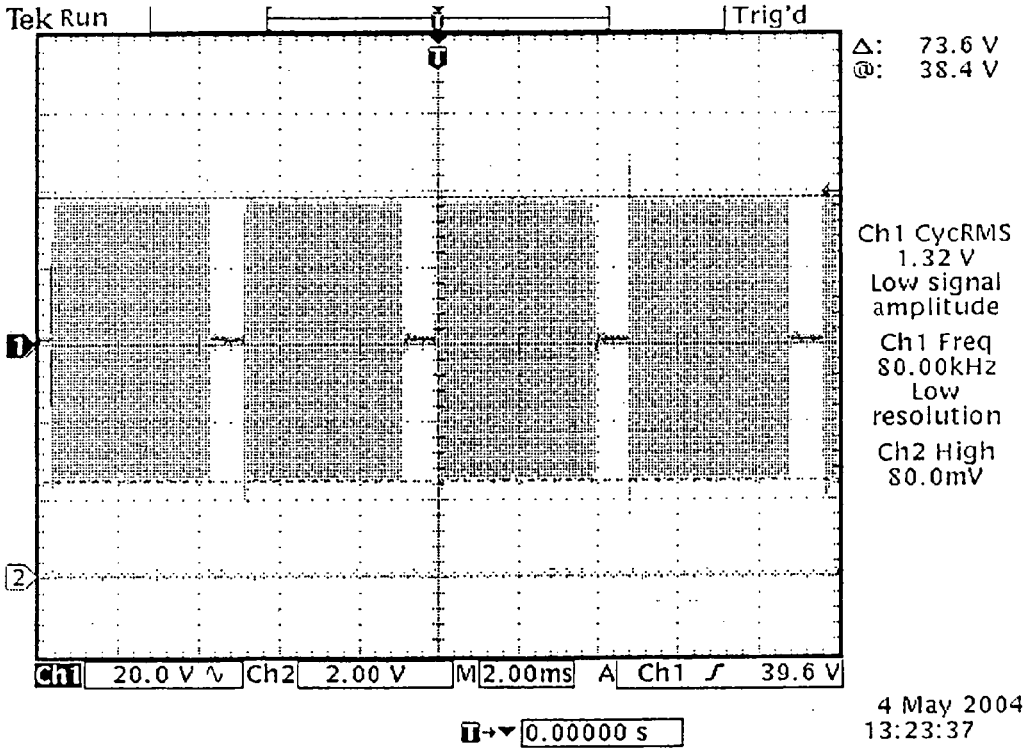
FIG. 10 is a diagram of actual measurements indicating the results of measuring static noise when adjoining cold-cathode fluorescent lamps are driven in phase.
Figure 11:
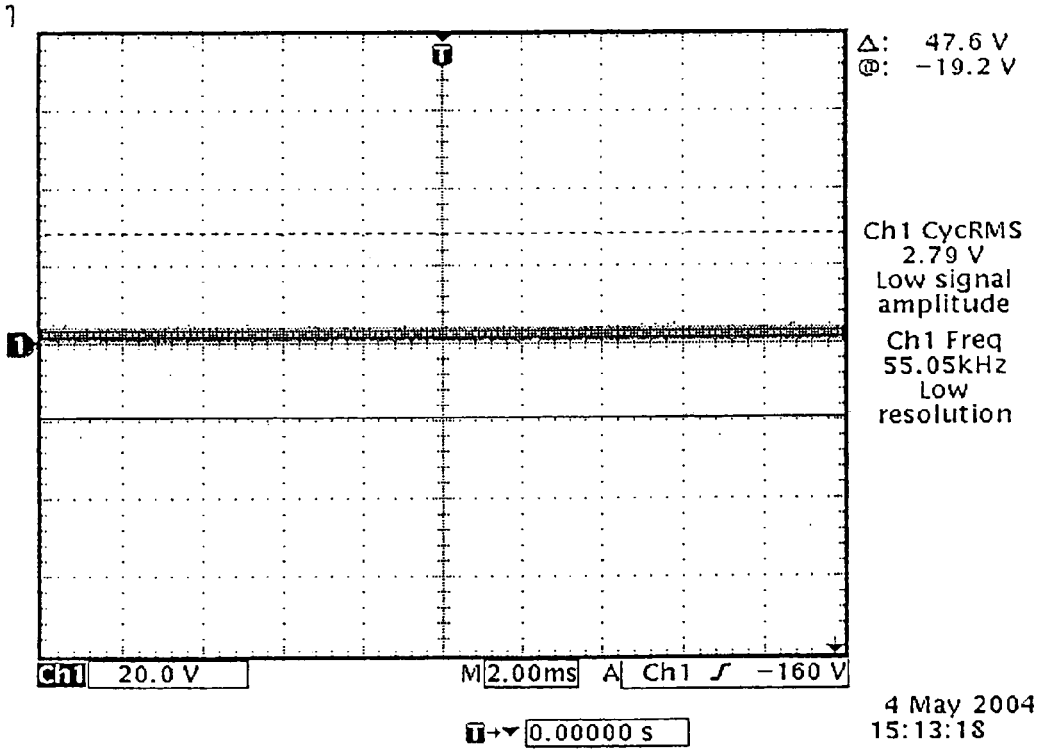
FIG. 11 is a diagram of actual measurements indicating the results of measuring static noise when adjoining cold-cathode fluorescent lamps are driven in opposite phases.
Figure 12:
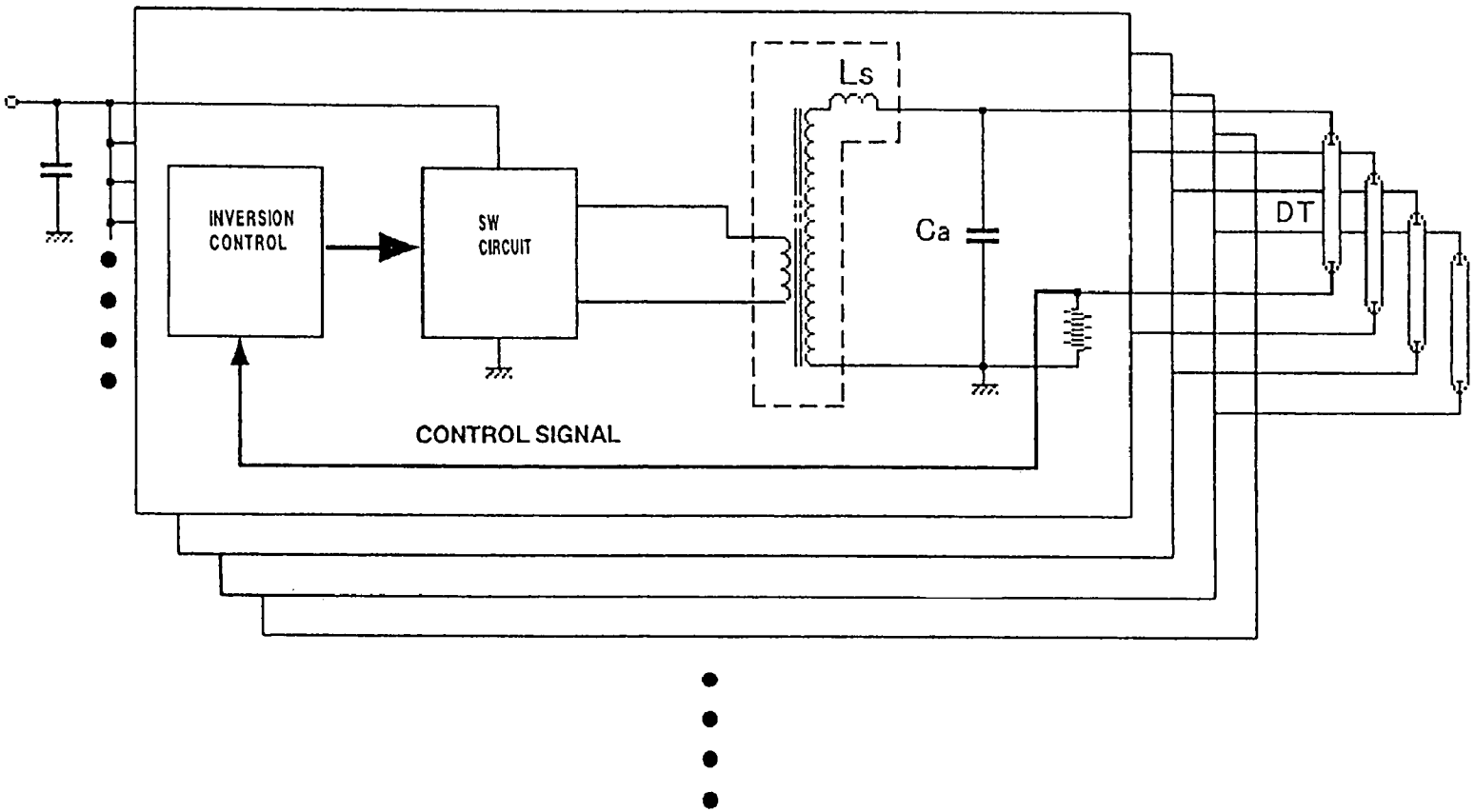
FIG. 12 is a circuit structural diagram showing one example of making the brightness of a conventional large surface light source uniform.

As clearly apparent from the comparison of the results, shown in FIG. 10, of measuring static noise when adjoining cold-cathode fluorescent lamps are driven in phase with the results, shown in FIG. 11, of measuring static noise when adjoining cold-cathode fluorescent lamps are driven in opposite phases, the electrostatic field is canceled out in the case of cold-cathode fluorescent lamps whose drive voltages have different polarities, thus making it possible to considerably reduce static noise generated from the backlight with a simple structure.

We claim:

1. A parallel lighting system for discharge lamps for a surface light source having a surface light source system, step-up transformers (T1, T2) and a shunt transformer (CT1), the surface light source system comprising:

multiple discharge lamps (DT), and a current shunt circuit module (CD) which lights said discharge lamps (DT) in parallel, wherein:

the surface light source system are driven by the step-up transformers (T1, T2) each including two resonance circuits which generate voltage waveforms different in phase by 180 degrees from each other (−VH, +VH), one input terminal and another input terminal of the surface light source system are driven by the voltage waveforms different in phase by 180 degrees from each other (−VH, +VH), and ground side terminals of the step-up transformers (T1, T2) are connected to a ground via the shunt transformer (CT1) in such a way that magnetic fluxes which are generated in windings of the shunt transformer are opposed to each other so that the currents respectively flowing in the windings cancel out the generated magnetic fluxes.

2. A parallel lighting system for discharge lamps for a surface light source having a surface light source system, step-up transformers (T1, T2, T3, T4) and shunt transformers (CT1, CT2, CT3), the surface light source system comprising:

multiple discharge lamps (DT), and a current shunt circuit module (CD) which lights the discharge lamps (DT) in parallel, wherein:

the surface light source system is constructed in such a way as to drive every other electrode of adjoining discharge lamps (DT) in opposite phases, the surface light source system is separated into two groups of surface light source systems, in each of the surface light source systems, one terminal of the surface light source system is driven by each of the phases of step-up transformers (T1, T2), and another terminal are driven by each of the phases of step-up transformers (T3, T4), and ground side terminals of the step-up transformers (T1, T2, T3, T4) are connected to ground via plural shunt transformers (CT1, CT2, CT3) in such a way that magnetic fluxes which are generated in windings of the plural shunt transformer are opposed to each other so that the currents respectively flowing in the windings cancel out the generated magnetic fluxes.

3. The parallel lighting system according to claim 1, wherein resonance capacitors (Ca1, Ca2, Ca3, Ca4) are separately provided on the step-up transformers (T1, T2) side and a surface light source side of said shunt transformer (CT1), and unbalance of a current flowing in said shunt transformer is compensated by adjusting values of said resonance capacitors to adequate values, thereby reducing a size and a shape of said shunt transformer (CT1).

* * * * *